United States Patent [19]

Ueno

[11] Patent Number: 5,048,355

[45] Date of Patent: Sep. 17, 1991

[54] ENGINE STARTER WITH A FRONT BRACKET PROVIDED WITH A DRAINAGE STRUCTURE

[75] Inventor: Hirokazu Ueno, Himeji, Japan

[73] Assignee: Mitsubishi Denki Kabushiki Kaisha, Tokyo, Japan

[21] Appl. No.: 521,963

[22] Filed: May 11, 1990

[30] Foreign Application Priority Data

May 15, 1989 [JP] Japan ..... 1-121926

[51] Int. Cl.[5] ..... F02N 15/06

[52] U.S. Cl. ..... 74/7 A; 74/7 E

[58] Field of Search ..... 74/6, 7 A, 7 L, 7 E; 123/179 M; 290/38 C, 48; 310/89, 91

[56] References Cited

U.S. PATENT DOCUMENTS 4,677,407 6/1987 Tanaka et al. ..... 335/202
4,779,470 10/1988 Morita et al. ..... 74/7 C X
4,808,871 2/1989 Morishita et al. ..... 310/89

FOREIGN PATENT DOCUMENTS 61-268870 11/1986 Japan .

*Primary Examiner*—Allan D. Herrmann
*Assistant Examiner*—David W. Laub
*Attorney, Agent, or Firm*—Sughrue, Mion, Zinn, Macpeak & Seas

[57] ABSTRACT

A starter for an automotive engine wherein the front bracket 9 forming part of the housing of the starter is provided with first and second drainage port 12, 16. An electromagnetic switch a of the starter is situated substantially horizontally, alongside of the motor portion. The first drainage port is formed at the bottom of the switch box portion 10 of the front bracket accommodating the front end portion of the plunger 8*a* of the electromagnetic switch, to communicate the interior of the switch box portion to the exterior. The second drainage port communicates with to the first drainage port from the interior of the lever box portion 11 which accommodates the fulcrum portion 7*a* of the lever transmitting the movement of the plunger of the electromagnetic switch to the pinion assembly of the starter axially slidably supported on the output shaft coupled to the rotor shaft of the motor of the starter.

2 Claims, 2 Drawing Sheets

ENGINE STARTER WITH A FRONT BRACKET PROVIDED WITH A DRAINAGE STRUCTURE

BACKGROUND OF THE INVENTION

This invention relates to starting motors for automotive engines, and more particularly to a drainage structure of the front bracket forming part of the housing structure thereof.

Let us first describe the drainage structure of the front bracket forming part of the housing of a conventional engine starter, wherein reference is made to FIG. 1, which shows an axial section of the essential portion of an engine starter.

The starter shown in FIG. 1 comprises a motor portion 1 accomodating an electric motor, whose armature shaft (i.e., rotor shaft) 2 is coupled, via a planetary reduction gear 3, to an overrunning clutch (i.e., one-way clutch transmitting torque only in one rotational direction) 4. A pinion 5 formed integrally with the clutch inner member of the overrunning clutch 4 is axially slidably supported on the output shaft 6 together with the overrunning clutch 4; the pinion assembly including the pinion 5 and the clutch 4 are translated on the output shaft 6 in the axial direction thereof by means of a lever 7 rotatably supported on a fulcrum portion 7*a* of the lever. One end of the lever 7 (shown at the top in FIG. 1) is engaged with a plunger 8*a* of an electromagnetic switch 8, while the other end thereof (shown at the bottom in FIG. 1) is engaged with a rear portion of the overrunning clutch 4.

Further, a front bracket 9 forming part of the starter housing is attached to the front end side of the motor portion 1, so as to support the electromagnetic switch 8, the lever 7, the output shaft 6, etc. (It is to be noted that the electromagnetic switch 8 is disposed, as described in detail below, substantially horizontally alongside of the motor portion 1 with a slight, downward inclination with respect to a horizontal plane including the motor axis as shown clearly in FIG. 2, which shows the rear end view of the front bracket.) The front bracket 9 comprises, in addition to the portion accomodating the clutch 4, the pinion 5, the output shaft 6, etc., two further portions: a switch box portion 10 (shown at the top in FIG. 1 and at the left in FIG. 2) in which the front end portion of the plunger 8*a* of the electromagnetic switch 8 and one arm of the lever 7 is accomodated; and a lever box portion 11 (see FIG. 2) supporting and accomodating the fulcrum portion 7*a* of the lever 7. As shown in FIG. 2, a tortuous drainage port 12 is formed at the bottom of the switch box portion 10 to communicate the interior of the switch box portion 10 to the outside. Incidentally, reference numeral 13 (at the lower right side in FIGS. 1 and 2) designates an opening at which the ring gear of the internal combustion engine is positioned so as to be engageable with the pinion 5 when the starter is attached to the engine; further, reference numeral 14 designates a stopper for limiting the forward translation of the pinion 5, and reference numeral 15 designates a bearing fitted to an opening formed in the front end of the front bracket 9 to support the front end of the output shaft 6.

The general method of operation of the starter of FIGS. 1 and 2 is well known: The electromagnetic switch 8 is energized when a key switch (not shown) of the automobile is turned on, so that by means of the resulting attraction of the plunger 8*a* (toward the left in FIG. 1), the lever 7 is turned counterclockwise as viewed in FIG. 1, to translate in the forward direction (toward right in FIG. 1) the pinion assembly including the overrunning clutch 4 and the pinion 5. As a result, the pinion 5 is engaged with a ring gear (not shown) of the engine situated at the opening 13. At the same time, a torque is generated by the motor portion 1 so as to rotate and drive the pinion 5 and thereby start the engine.

In an environment where the automobile runs through puddles, etc., water may intrude into the interior of the starter due to the suction of water through the junction between the front bracket 9 and the electromagnetic switch 8, etc., or due to the splashing up of water at the side of the engine, which splashing up of water results in an intrusion of water into the starter from the opening 13 of the front bracket 9, etc. In the case where the electromagnetic switch 8 is situated substantially horizontally alongside the motor with a slight downward inclination as shown in FIG. 2, the water entering into the switch box portion 10 of the front bracket 9 is drained through the drainage port 12 as indicated by the arrows in FIG. 2.

The above drainage structure, however, suffers from the following disadvantage. Namely, in the case where the starter is in a severe water flooding environment—especially in the case where a lot of water splashed up at the side of the engine intrudes into the starter via the opening 13 in the front bracket 9—the water which, after intruding into the front bracket 9 via the opening 13, etc., enters into the switch box portion 10 via the lever box portion 11 thereof, enters, if the amount of intruding water exceeds the drainage capacity of the drainage port 12, into the interior of the electromagnetic switch 8, the switching function of which switch is then adversely affected by the intruding water.

SUMMARY OF THE INVENTION

It is therefore an object of this invention to provide a starter having a front bracket which is provided with a drainage structure capable of draining water even in a severe water flooding environment.

The above object is accomplished in accordance with the principle of this invention by a starter device for an automotive internal combustion engine, which comprises the following: an electric motor portion accomodating an electric motor; an output shaft coupled to a rotor shaft of the motor; a pinion assembly axially slidably supported on the output shaft, a pinion of said pinion assembly being adapted to be engaged with a ring gear of the internal combustion engine when translated to a front position thereof; an electromagnetic switch attached to a side of the electric motor portion; a lever rotatably supported on a fulcrum portion thereof, two end portions of the lever engaging with the pinion assembly and a front end of a plunger of the electromagnetic switch, respectively, so as to transmit a movement of the plunger of the electromagnetic switch to the pinion assembly; and a front bracket secured to a front side of the motor to accomodate the output shaft and the pinion assembly, said front bracket including a substantially cup-shaped switch box portion accomodating a front end of the electromagnetic switch situated to a horizontal side of the portion accomodating the output shaft and the pinion assembly, and a lever box portion accomodating the fulcrum portion of the lever situated between the switch box portion and the portion accomodating the output shaft and the pinion assembly, wherein a first drainage port communicating an interior of the switch box portion to outside is formed at a lower side portion of the cup-shaped switch box portion, and a second drainage port is provided which communicates an interior of the lever box portion to an intermediate portion of the first drainage port.

The features of this invention which are believed to be characteristic of this invention are set forth with particularity in the appended claims. However, details of the structure and method of operation of this invention, together with further objects and advantages thereof, may best be understood from the following detailed description of the preferred embodiment, taken in conjunction with the accompanying drawings.

BRIEF DESCRIPTION OF THE DRAWINGS

In the drawings, like reference numerals represent like or corresponding parts.

DETAILED DESCRIPTION OF THE PREFERRED EMBODIMENT

Figure 2:
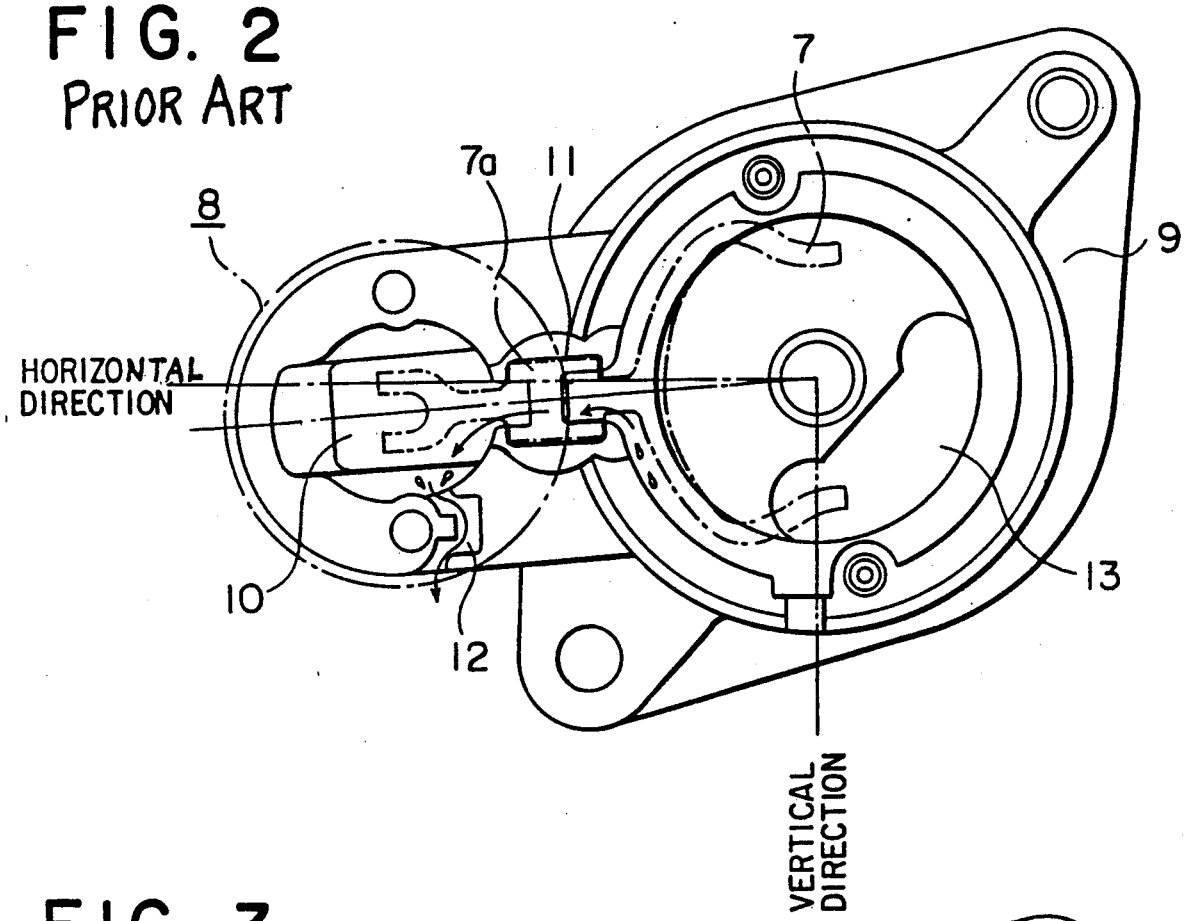
FIG. 2 PRIOR ART
FIG. 2 is a rear end view of a front bracket forming part of the housing structure of a starter provided with a drainage structure.
Figure 3:
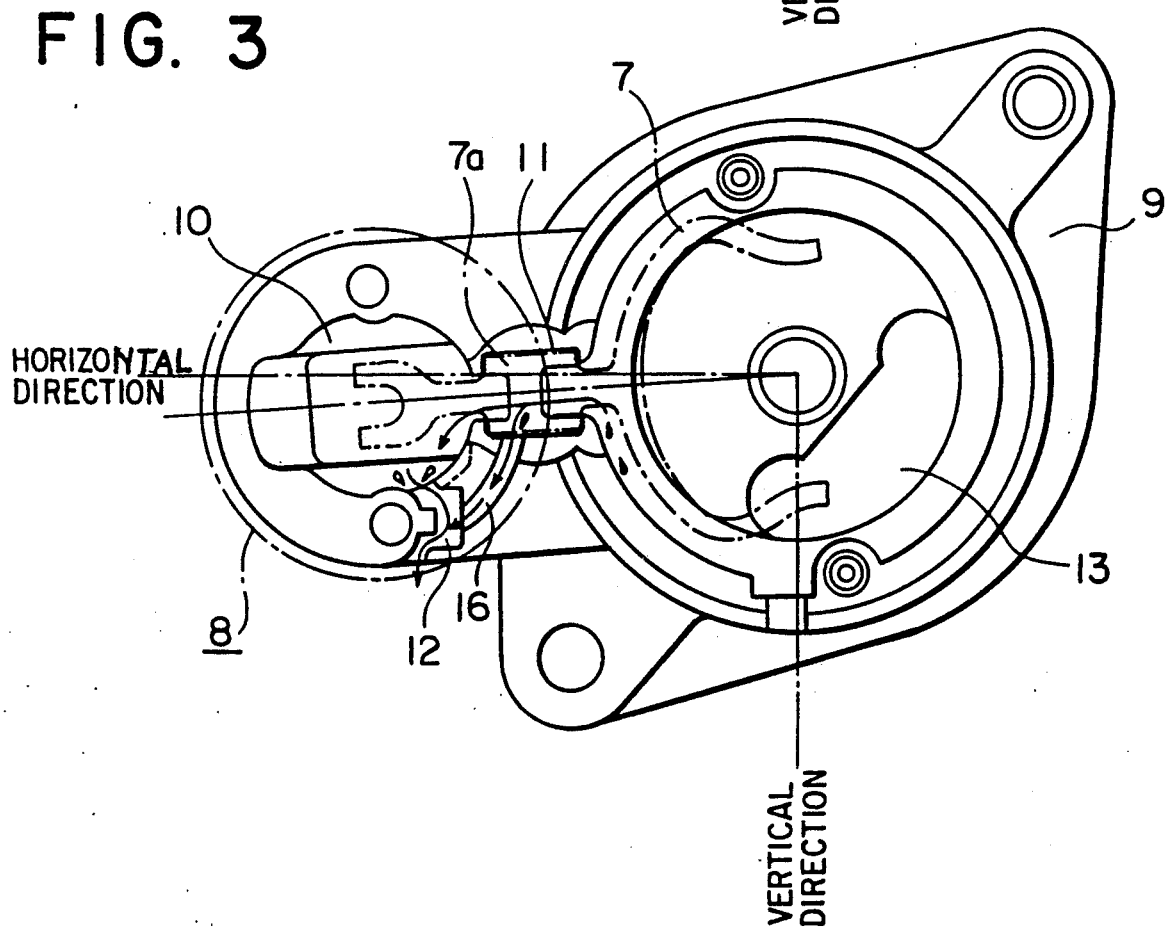
FIG. 3 is a view similar to that of FIG. 2, but showing a rear end view of a front bracket provided with a drainage structure according to this invention.

Referring now to FIG. 3 of the drawings, let us describe an embodiment of this invention. It is noted that the axial sectional view of the starter to which the front bracket of FIG. 3 is attached is similar to that shown in FIG. 1, wherein FIG. 1 may be considered to represent the axial section of the starter as viewed from the top. Thus, for the parts not described hereinbelow, reference is to be made to the description of FIGS. 1 and 2 above, wherein like reference numerals represent like or corresponding parts.

In the case of the starter of FIG. 3, a second drainage port 16 is formed in the front bracket to communicate the interior of the lever box portion 11 to an intermediate portion of the first tortuous drainage port 12 formed substantially at the bottom of the side wall of the substantially cup-shaped switch box portion 10. These drainage ports 12 and 16 comprise grooves formed on an inner (or rear) end surface of the front end bracket 9, as shown in FIG. 3. Further, it is noted that the electromagnetic switch 8 is situated horizontally alongside of the motor portion, such that a line drawn from the central axis of the motor portion (i.e. the axis of the output shaft) to that of the electromagnetic switch 8 deviates slightly downwardly from the horizontal direction (from a horizontal plane including the motor axis) as shown clearly in FIG. 3.

Figure 1:
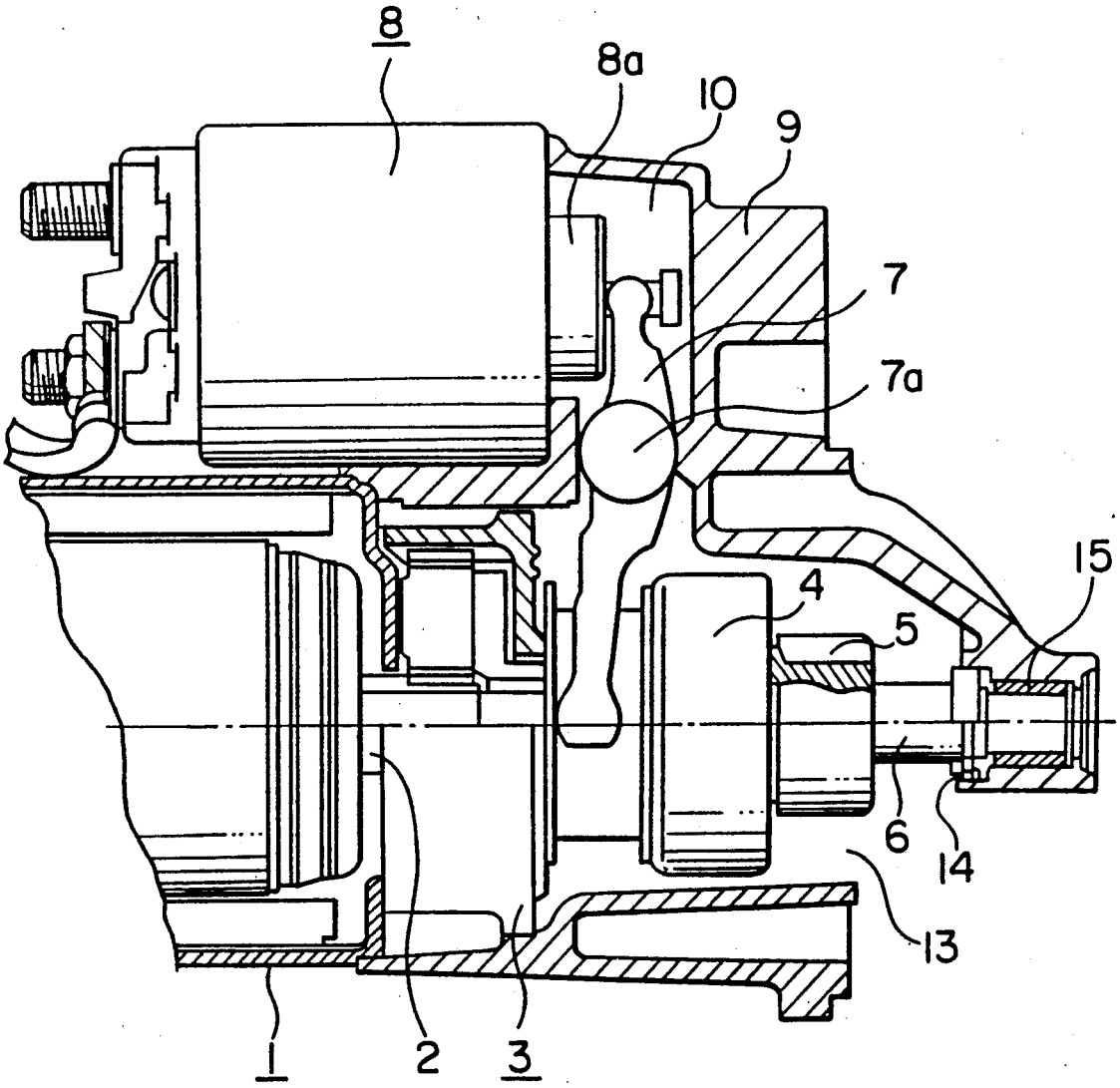
FIG. 1 PRIOR ART
FIG. 1 is a partial axial plan view of a starter for an automotive engine.

The general method of operation of the starter provided with the front bracket of FIG. 3 is similar to that of the starter of FIGS. 1 and 2 described above; thus, further description thereof is deemed unnecessary. On the other hand, the drainage of water via the ports 12 and 16 is effected as follows.

In the case where a lot of water intrudes into the interior of the starter via the opening 13 in the front bracket 9, etc., the water which enters into the switch box portion 10 via the lever box portion 11 first flows into the second drainage port 16, and then is drained via the first drainage port 12. The water which exceeds the drainage capacity of the second drainage port 16 and hence cannot be drained therethrough flows into the switch box portion 10; however, since the amount of such water entering into the switch box portion 10 is substantially reduced, the water is ensured to be drained via the first drainage port 12 and thus does not stay within the switch box portion 10. Hence, the intrustion of water into the electromagnetic switch 8, which intrusion has adverse effects on the switching operation thereof, can be prevented. As a result, the reliability of the starter is improved.

While description has been made of the particular embodiment, it will be understood that many modifications may be made without departing from the spirit of this invention. The appended claims are contemplated to cover any such modifications as fall within the true spirit and scope of this invention.

What is claimed is:

1. A starter device for an automotive internal combustion engine, comprising:

an electric motor portion accommodating an electric motor, and having a horizontally oriented axis;

an output shaft coupled to a rotor shaft of the electric motor;

a pinion assembly axially slidably supported on the output shaft, a pinion of said pinion assembly being adapted to be engaged with a ring gear of the internal combustion engine when translated to a front position thereof;

an electromagnetic switch attached to a side of the electric motor portion, and having a horizontally oriented axis;

a lever rotatably supported on a fulcrum portion thereof, two end portions of the lever engaging with the pinion assembly and a front end of a plunger of the electromagnetic switch, respectively, so as to transmit a movement of the plunger of the electromagnetic switch to the pinion assembly; and a front bracket (9) secured to a front side of the motor portion to accommodate the output shaft and the pinion assembly, said front bracket including a substantially cup-shaped switch box portion (10) accommodating a front end of the electromagnetic switch and situated horizontally alongside of a portion of the front bracket accommodating the output shaft and the pinion assembly, and a lever box portion (11) accommodating the fulcrum portion of the lever situated between the switch box portion and the portion accommodating the output shaft and the pinion assembly, wherein a first drainage port (12) communicating an interior of the switch box portion to outside is formed in a lower side of the cup-shaped switch box portion, and a second drainage port (16) is formed in the front bracket which communicates an interior of the lever box portion to an intermediate portion of the first drainage port.

2. A starter device as claimed in claim 1, wherein said first and second drainage ports comprises grooves formed on a rear end surface of the front bracket.

* * * * *